United States Patent [19]

Ogle et al.

[11] 4,107,576

[45] Aug. 15, 1978

[54] PANEL-TYPE DISPLAY DEVICE

[75] Inventors: James A. Ogle, Neshanic Station; George E. Holz, North Plainfield, both of N.J.

[73] Assignee: Burroughs Corporation, Detroit, Mich.

[21] Appl. No.: 746,875

[22] Filed: Dec. 2, 1976

Related U.S. Application Data

[60] Division of Ser. No. 624,532, Oct. 22, 1975, Pat. No. 4,035,689, which is a division of Ser. No. 487,955, Jul. 12, 1974, Pat. No. 3,989,981, which is a continuation of Ser. No. 255,133, May 19, 1972, abandoned, which is a continuation of Ser. No. 850,984, Aug. 18, 1969, abandoned, which is a continuation-in-part of Ser. No. 828,792, May 28, 1969, abandoned.

[51] Int. Cl.[2] ..... H05B 37/00

[52] U.S. Cl. ..... 315/169 TV; 313/201; 313/220

[58] Field of Search ..... 313/201, 220; 315/169 TV, 169 R

[56] References Cited

U.S. PATENT DOCUMENTS

| | | | |
|---|---|---|---|
| 3,334,269 | 8/1967 | L'Heureux | 315/169 X |
| 3,644,925 | 2/1972 | Kupsky | 315/169 TV X |

*Primary Examiner*—Lawrence J. Dahl

*Attorney, Agent, or Firm*—Kevin R. Peterson; Robert A. Green; Edward J. Feeney, Jr.

[57] ABSTRACT

A display device comprising a panel structure including a plurality of gas-filled cells and including, within the body of the panel, gas communication channels extending between selected cells to provide a selective flow of excited gaseous particles from certain cells to others to prime the receiving cells and thereby control the transfer of glow between the cells. The panel includes a series of parallel cathode strips and means for forming glow cells along each of the strips. A reset cell is provided at each end of each cathode strip, and means are provided for energizing each pair of reset cells, in turn, and, as each pair is energized, the cells along its cathode are energized selectively to provide a display of characters in the entire panel.

16 Claims, 8 Drawing Figures

FIG. 6
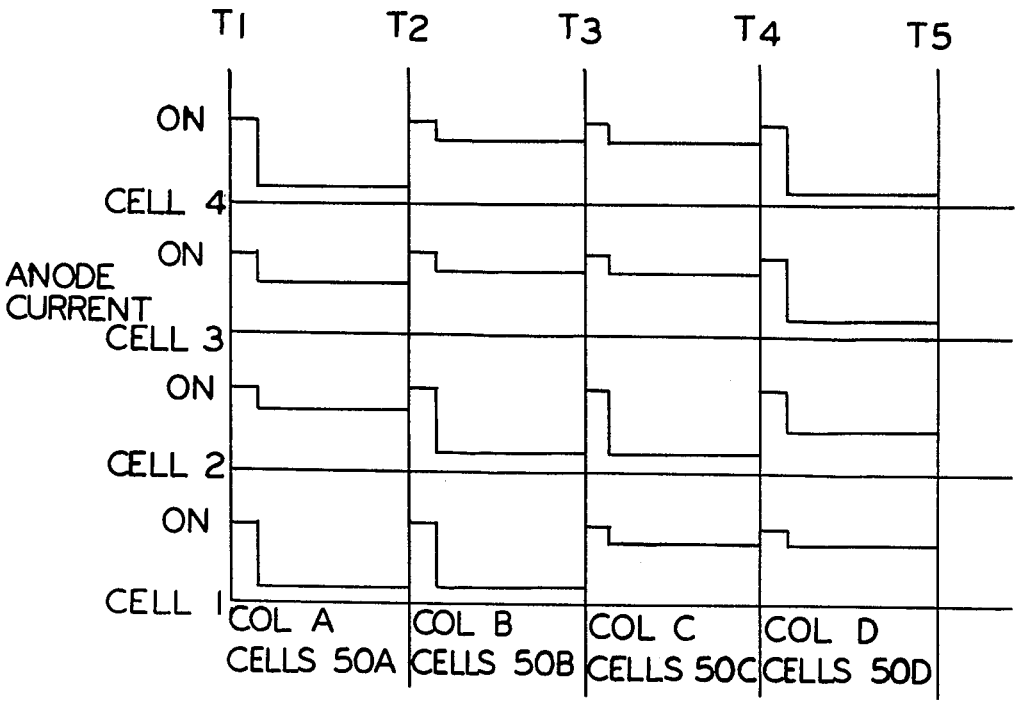
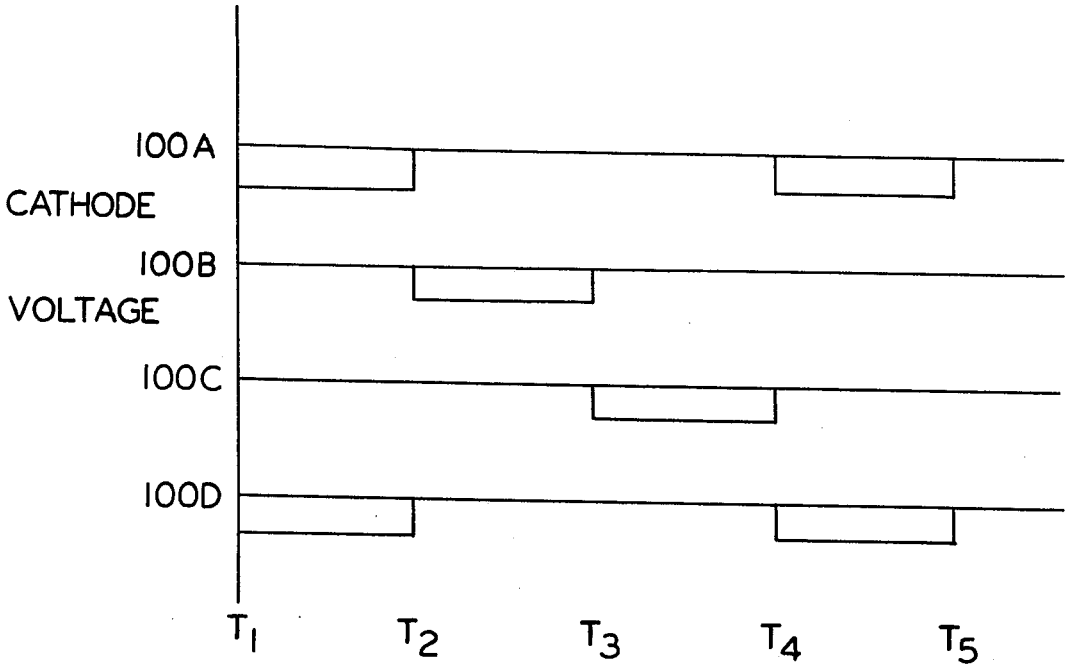
FIG. 7

PANEL-TYPE DISPLAY DEVICE

This application is a division of application Serial No. 624,532, filed Oct. 22, 1975, now U.S. Pat. No. 4,035,689, as a division of application Ser. No. 487,955, filed July 12, 1974, now U.S. Pat. No. 3,989,981, as a continuation of application Ser. No. 255,133, filed May 19, 1972, now abandoned, as a continuation of application Ser. No. 850,984, filed Aug. 18, 1969, now abandoned, as a continuation-in-part of application Ser. No. 828,792, filed May 28, 1969, now abandoned.

BACKGROUND OF THE INVENTION

The present invention concerns panel display devices of the type which include large numbers of gas-filled cells arrayed in rows and columns and energizable selectively to display a character or message or any other form of display. To date, such devices have appeared as laboratory models under investigation from time to time over a period of many years, but no one has yet succeeded in making a commercial device. In general, such devices include at least two electrodes, an anode and a cathode, for each cell, and a separate driver circuit for each cathode and each anode, or for each row of cathodes and each column of anodes, for applying thereto the voltages needed to turn on each coll and generate visible glow therein.

Although panels can be operated in this way, it can be seen that, in a panel which includes thousands of cells, the provision of a separate driver for each cathode and each anode, or even for each row and column of cells, is prohibitively expensive and complex. The prior art provides no satisfactory solution to this problem.

SUMMARY OF THE INVENTION

The present invention generally provides a display panel including a plurality of light-producing, gas-filled cells and including means within the panel itself for facilitating the energization of cells and thus simplifying the required external drive circuitry. The panel includes means for forming columns of display cells, and a pair of reset cells, at the ends of each such column, for facilitating scanning along the column.

DESCRIPTION OF THE DRAWING

FIG. 6 shows qualitatively the anode current which flows in some of the cells of the panel of FIG. 5 during a portion of a cycle of operation;

FIG. 7 shows cathode voltages applied to some of the cells in the panel of FIG. 5 during a portion of a cycle of operation;

DESCRIPTION OF THE PREFERRED EMBODIMENTS

Figure 1:
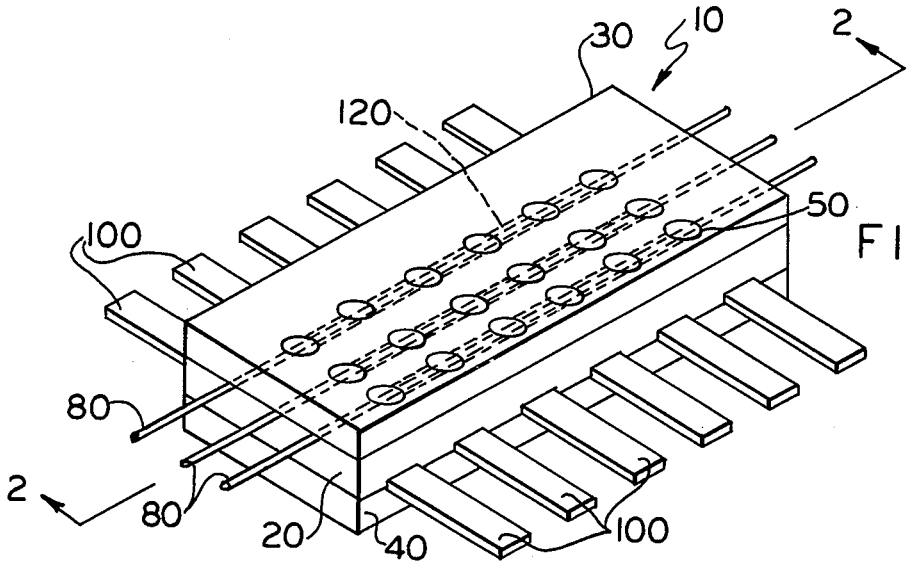
FIG. 1 is a perspective view of a display panel embodying the invention.

A gas-filled display device 10 embodying the invention is in the form of a flat panel and comprises a sandwich of flat plates including a central plate 20 of glass or ceramic, a top viewing plate 30 of glass, and a bottom plate 40 of glass or ceramic. The central plate 20 is provided with rows and columns of holes or cells 50, and it has a top surface 60 and a bottom surface 70. The cells 50 are operated as information display cells and are filled with a gas of the type which can sustain cathode glow.

The gas in the cells 50 may be neon, argon, etc., or mixtures of these gases, and is preferably a Penning mixture in which the gases of the mixture have related energy levels such that the metastable atoms of one gas produce ions of the other gas. Vapors of metals such as mercury may also be added to the gas to minimize sputtering. While a Penning mixture of neon and mercury might be used, the mercury vapor pressure, and hence the relative pressures of such gases, are temperature-sensitive. It is desirable to avoid the temperature-sensitivity problem, at least insofar as the functioning of the Penning mixture is concerned. Therefore, it is preferable to include a second gas which forms a Penning mixture with neon, and then add mercury to the mixture. Neon-xenon has been found to be particularly effective as a Penning mixture in one embodiment of the invention, for reasons which will be discussed. The gas pressure is preferably between 100 to 250 Torr, and, more particularly, about 175 Torr.

The device 10 is provided with a top set of parallel electrodes 80 and a bottom set of parallel electrodes 100, with the sets being perpendicular to each other and arrayed so that each cell has two electrodes, one at the top of the cell and one at the bottom of the cell. A cell is fired and caused to glow by the application of suitable potentials to the electrodes 80 and 100 which cross each other at the particular cell. In the following description, the upper electrodes are considered to be anodes, and the lower electrodes are considered to be cathodes, and, for purposes of this description, the device 10 is oriented so that the anodes are row electrodes and each is aligned with a row of cells, and the cathodes are column electrodes and each is aligned with a column of cells.

The electrodes may be flat metal strips, or they may be wires, and they may be seated in slots or depressions, either in the central plate or in the top or bottom plates, if desired. In addition, the upper conductors 80, if they are flat strips, are provided with holes 90 (FIG. 2) where they overlay cells 50 to permit a glowing or fired cell to be seen by a viewer looking through top plate 30 when the device 10 is in operation. Viewability of cells can also be achieved if electrodes 80 are wires which are narrower than the cells 50 and do not cover the cells completely. If desired, each lower cathode electrode may be provided with a raised portion 110 which projects into each cell with which it is aligned. This permits adjustment of the anode-to-cathode spacing in each cell, if necessary; however, this is not required. Also, it provides a convenient way of aligning the cathode electrodes 100 with the cells of the respective columns.

The central plate 20 and the top and bottom glass plates 30 and 40 are usually rectangular, with the top and bottom plates being somewhat larger than the center plate (shown only in FIG. 2) to permit a sealing material 42, such as a glass frit, to be placed between them to seal all of the plates together in a gas-tight assembly. The row and column conductors extend beyond the edges of the plates so that they can be readily connected to electrical circuitry.

It is known that a gas cell which is exhibiting glow generates excited particles including gas ions, electrons, uncharged metastable atoms, and the like. According to the invention, means are provided for permitting selective gas communication and the flow of such excited particles from a glowing or fired cell to adjacent cells in the panel, particularly for permitting communication in the direction in which glow is to be propagated from cell to cell. This free flow and availability of excited particles facilitates the selective transfer of glow from a fired cell to an adjacent cell. Thus, a fired cell, in providing excited particles for an adjacent cell, acts as a priming cell therefor. This permits a simplification in the drive circuitry which is described in greater detail below.

Figure 2:
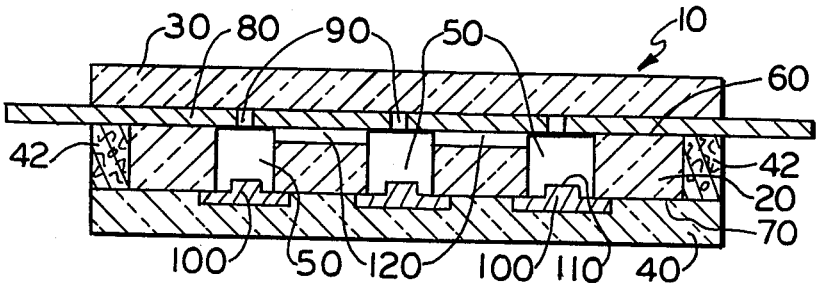
FIG. 2 is a sectional view along the lines 2—2 in FIG. 1, with the dimensions and number of display cells being changed to simplify the drawing.
Figure 3:
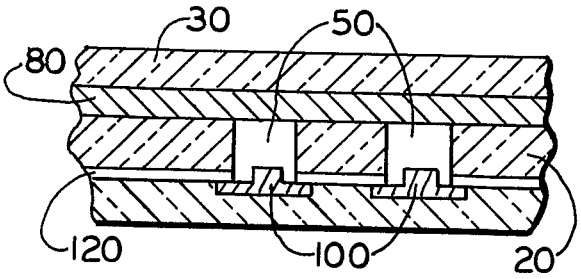
FIG. 3 is a sectional view showing a modification of a portion of the panel of FIG. 2.
Figure 4:
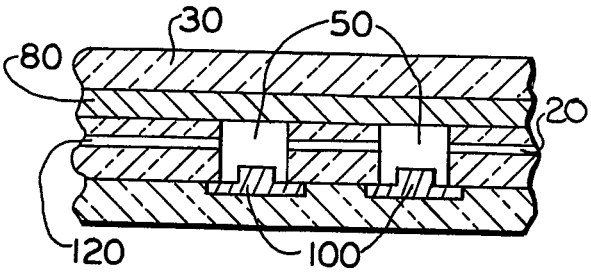
FIG. 4 is a sectional view showing another modification of a portion of the panel of FIG. 2.

One arrangement for providing the desired gas communication comprises slots 120 formed in the central plate 20. The slots may be provided at various locations, for example, in the top surface 60 as shown in FIG. 2, in the bottom surface 70 as shown in FIG. 3, or at an intermediate location as shown in FIG. 4.

Depending on the mode of operation of a panel, the slots 120 may extend between adjacent anodes and/or between adjacent cathodes, as will be clear from the description below. However, at the suggested operating pressure range of 100 to 250 Torr, the slots preferably extend between the cathodes for reasons which will be explained.

Display panel 10 embodying the invention includes any desired number of rows and columns of display cells 50 for displaying a message and, in addition, a group of cells 50S known as starter cells or particle-supply or priming cells for providing excited particles for expediting the turn-on of the information display cells 50. In one embodiment of the invention, illustrated schematically in FIG. 5, display panel 10 includes rows and columns of display cells 50A, 50B, 50C, etc. and a column of particle-supply cells 50S to the left of the column of cells 50A. Each cell 50S is connected to the adjacent cell 50A by a slot 120. In addition, the particle supply cells are connected together by column slots 126. The cells 50S have their own column cathode 100S connected to a suitable power source or driver 161, and they share the anode electrodes 80 with the display cells 50. The particle-supply cells 50S need not be, and are preferably not, seen by a viewer and may be obscured by the upper anode electrodes associated therewith.

The panel 10 also includes a "keep-alive" mechanism or a source of first electrons which, as is well known in the art, are required to initiate glow discharge in a gas cell. In panel 10, the keep-alive mechanism comprises a column of gas cells 123 positioned in operative relation with the supply cells 50S and having their own anode 124 and cathode 125. Such cells 123 are constantly energized and glowing but are concealed from view. The keep-alive mechanism may comprise just a single cell 123 adjacent to one of the supply cells and having its own anode 124 and cathode 125 connected to voltage supply Vk, by means of which it is continuously energized and held ON and glowing.

In a typical panel 10, the central plate 20 is about 1 mm. in thickness, the top and bottom plates 30 and 40 are about 1 to 3 mm. in thickness, and the cells 50 are about 0.04 inch in diameter at a density of about sixteen cells per linear inch. The electrodes 80 and 100 are about 0.05 inch wide and about 5 mils deep. The communication slots 120 are 0.04 inch wide and 0.015 inch deep, while slots 126 are 10 × 5 mils.

In general terms, the display panel 10 is operated in a scanning mode in which each column of display cells is turned ON, in turn, from left to right, and the glow in each column is modulated in accordance with input signal information. The scanning operation is repeated continuously at such a rate that a stationary but changeable message is displayed by the panel.

Figure 5:
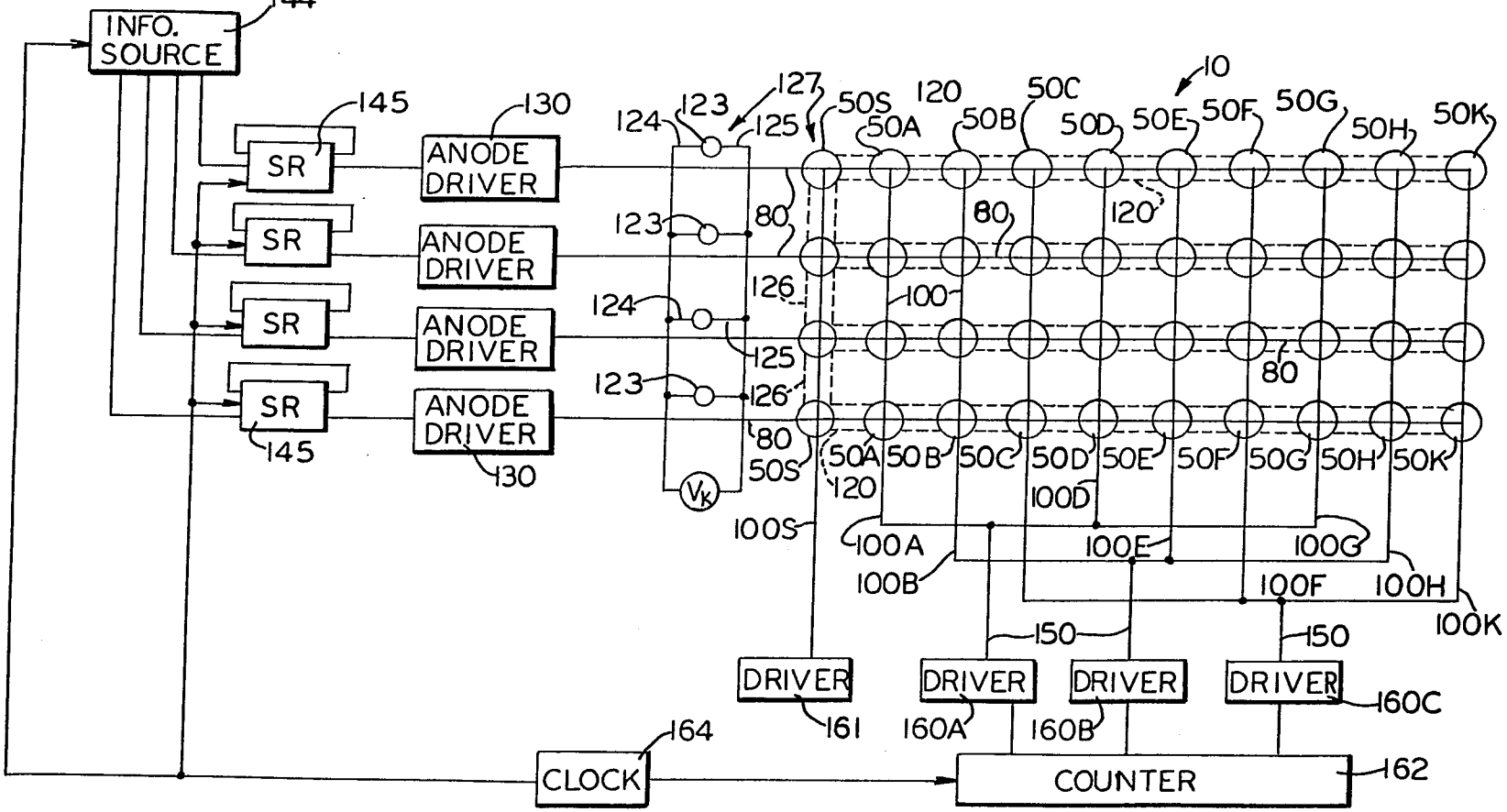
FIG. 5 is a schematic representation of the panel of FIG. 1 and an electronic system in which it may be operated.

Considering FIG. 5, in one mode of operation of panel 10, operating potential is first applied to the particle-supply cells 50S, and these cells turn on with the aid of the keep-alive cells 123. These cells 50S are also referred to as reset cells since they serve to reset the column scan of the display panel to the first column. The glowing gas in cells 50S produces excited particles which diffuse in all directions and through slots 120 to the adjacent OFF cells 50A. Next, operating potentials are removed from cells 50S and are applied to cells 50A in the first column of display cells, and these cells 50A turn ON relatively easily because of the excited particles which have diffused to them through slots 120, and because of the excited particles still present in the extinguished cells 50S which are attracted to them by the applied potentials. After cells 50A turn ON, the glow in them is modulated in accordance with input signal information applied to the row anodes 80. While cells 50A are ON, excited particles diffuse from them through slots 120 to cells 50B. Next, operating potentials are removed from cells 50A, and they are applied to cells 50B, and cells 50B turn ON, just as cells 50A had turned on previously. The glow in cells 50B is then modulated in accordance with input information on anodes 80. Each column of cells, in turn, is turned ON in this same way, with new041075763 signal information being applied to anodes 80 as each new column is turned ON, and, when the last column is reached, the cycle is repeated, at such a rate that a message is displayed in the panel.

Considering FIG. 5 in greater detail, it includes a system 127 and a panel 10 shown in schematic form. The system 127 includes a source of information signals 144, of any suitable type, which is coupled to the inputs of recirculating shift registers 145, and the output terminals of the respective shift registers are coupled to and operate anode drivers 130, which are in the form of current sources connected to the row anodes 80. A clock circuit 164 operating in the range of 5 to 20 kh is connected to and operates in synchronism with the information source 144, the shift registers 145, and a counter 162.

The column cathode electrodes 100 of panel 10 are connected in groups, with every third cathode being interconnected. Thus, the cathodes of columns 50A, 50D and 50G are interconnected, the cathodes of columns 50B, 50E and 50H are interconnected, and the cathodes of columns 50C, 50F and 50I are interconnected. Each of these groups of cathodes is connected by a lead 150 to a driver or switching circuit 160A, 160B, or 160C, for applying operating potentials to the cathodes. Negative-going pulses are applied by the drivers 160, and these cooperate with corresponding relatively positive anode voltages, generated by the anode drivers 130, to initiate and control cell glow. Counter 162 operates the cathode drivers 160A, 160B and 160C sequentially, and, as noted, it is coupled to a clock circuit 164 to provide the required synchronism between the energization of the respective cathodes and the application of signal information to the anodes.

In the operation of the panel 10, first, all of the anode current drivers 130 are turned on to apply a turn-on level of positive potential to all of the row anode electrodes 80, and, at the same time, a potential, negative with respect to the anodes, is applied to the cathode 100S by driver 161, whereby current flows through the particle-supply cells 50S, and they turn ON and glow. The turn-on of cells 50S is facilitated by the keep-alive cells 123. As cells 50S glow, they generate excited particles which diffuse into slots 120 and into the first column of display cells 50A.

Next, cathode driver 161 of cells 50S is turned off, and the first cathode driver 160A is energized to apply a negative potential to cathode 100A associated with cells 50A. This also has the effect of applying a negative potential to cathodes 100D and 100G associated with cells 50D and 50G, respectively. All of the current sources 130 are still set at the level which provided the turn-on current for cells 50S, so that a rapid glow transfer to cells 50A is achieved. Typical anode current curves and cathode voltage curves have been shown in FIGS. 6 and 7.

During the transfer or switching period, when driver 161 is turned off and the first cathode driver 160A is turned on, current flow through cells 50S is discontinued and the potential of the anodes 80 tends to rise. Thus, when driver 160A is turned on, the resultant potential across cells 50A combines with the excited particles present in cells 50A by diffusion, and the large numbers of particles attracted by the applied potential, to cause cells 50A to turn ON and current flows through cells 50A. The potential on the anodes 80 then drops to a relatively low level.

The more remote cells 50D and 50G, which are also coupled to the first cathode driver 160A, do not have the proper combination of applied voltage and accessibility to the supply of excited particles to cause them to turn ON and glow. The reason for this is that, either because the lifetime of the excited particles of the cells is short or because they are removed at the cell walls or electrodes, these particles are available for only a relatively short time, and they are not likely to travel, at least in any quantity, farther than one column of cells. Thus, they selectively prime only the adjacent cells, and the panel can consequently be scanned with only three column drivers 160, rather than a separate driver for each column.

The waveforms of FIG. 6 illustrate the turn-on anode current flowing through all cells 50A at time t1, which represents the time at which operating potential is first applied to cells 50A by driver 160A, as shown by FIG. 7.

Shortly after cells 50A are turned on by driver 160A, the anode current flow through the drivers 130 is modulated in accordance with the received signal information. This modulation is a control of the anode current level at various levels between a very low level which is insufficient to render the cell visible and a very high level which is sufficient to produce a very bright glow discharge. Also, it includes intermediate levels to produce a gray scale display. Once set, the current level remains fixed for one column scan period, although this is not essential, but the level is changed as the scan proceeds from column to column, as required by the signal information from source 144, to produce a display corresponding to such information.

The modulation can, of course, be made up of just two current levels, if gray scale is not desired. In this event, a current corresponding to a desired brightness is selected for one level and a very low current is selected for the second level, and the result is a binary-type or OFF-ON visual display.

As shown in FIG. 6, once the signal information is applied by anode drivers 130, shortly after time t1, the current flow in the 50A cells is maintained at various levels. As represented, the top and bottom cells 50A, called cells 1 and 4 in FIG. 6, are at a very low current level. These cells are actually OFF from a visual or light output standpoint. However, they are not OFF from a glow discharge standpoint. Rather, they are held at a very low glow discharge level, so that the glow discharge in these cells is not visible from the front of the panel, and yet the cells nevertheless maintain a source of excited particles sufficient to prime the corresponding cells 50B of the next column. Cells 2 and 3 on the other hand, exhibit relatively high current levels which differ slightly from one another to produce the desired brightness levels.

At time t2, the first cathode driver 160A is turned off, and the second cathode driver 160B is turned on, to apply cathode potential to cells 50B, the potential also being applied to cells 50E and 50H. Simultaneously, the intensity of the current flow from the anode drivers 130 (FIG. 6) is increased to a high level, so that a rapid transfer of the glow to the second column of cells 50B is achieved, facilitated by the transfer of clouds of excited particles through slots 120.

Immediately thereafter, current flow from anode drivers 150 is modulated in accordance with input signal information, and in accordance with brightness levels to be displayed by the various cells 50B. This is illustrated in FIG. 6 which shows in column B, cells 1 and 2 OFF from a visual standpoint, through glowing at a low level, and cells 3 and 4 ON at about equal current and brightness levels. This transfer operation is repeated for each column of cells along the entire display device from left to right until the last column of cells is reached, and its selected cells are turned ON at the desired levels, at which time all cathode drivers 160 are turned off and the starter or reset cells 50S are energized again by driver 161, and the cycle is repeated.

If desired, the turn-on of the starter cells 50S at the beginning of each cycle may be controlled automatically by deriving a signal from the last column of display cells when the latter cells are turned ON, or OFF.

The foregoing scanning cycle is repeated continuously at a sufficient rate, such as 5 to 20 kh, that the cells which are energized for only short periods during each scan appear to remain on, without any visible flicker, and display a stationary but changeable message. As the signal inputs to the anode current drivers change, the modulated anode currents also change and so does the visible message.

Parent application Ser. No. 624,532, which is incorporated herein by reference, describes the theory of operation of the panel 10 in greater detail.

Figure 8:
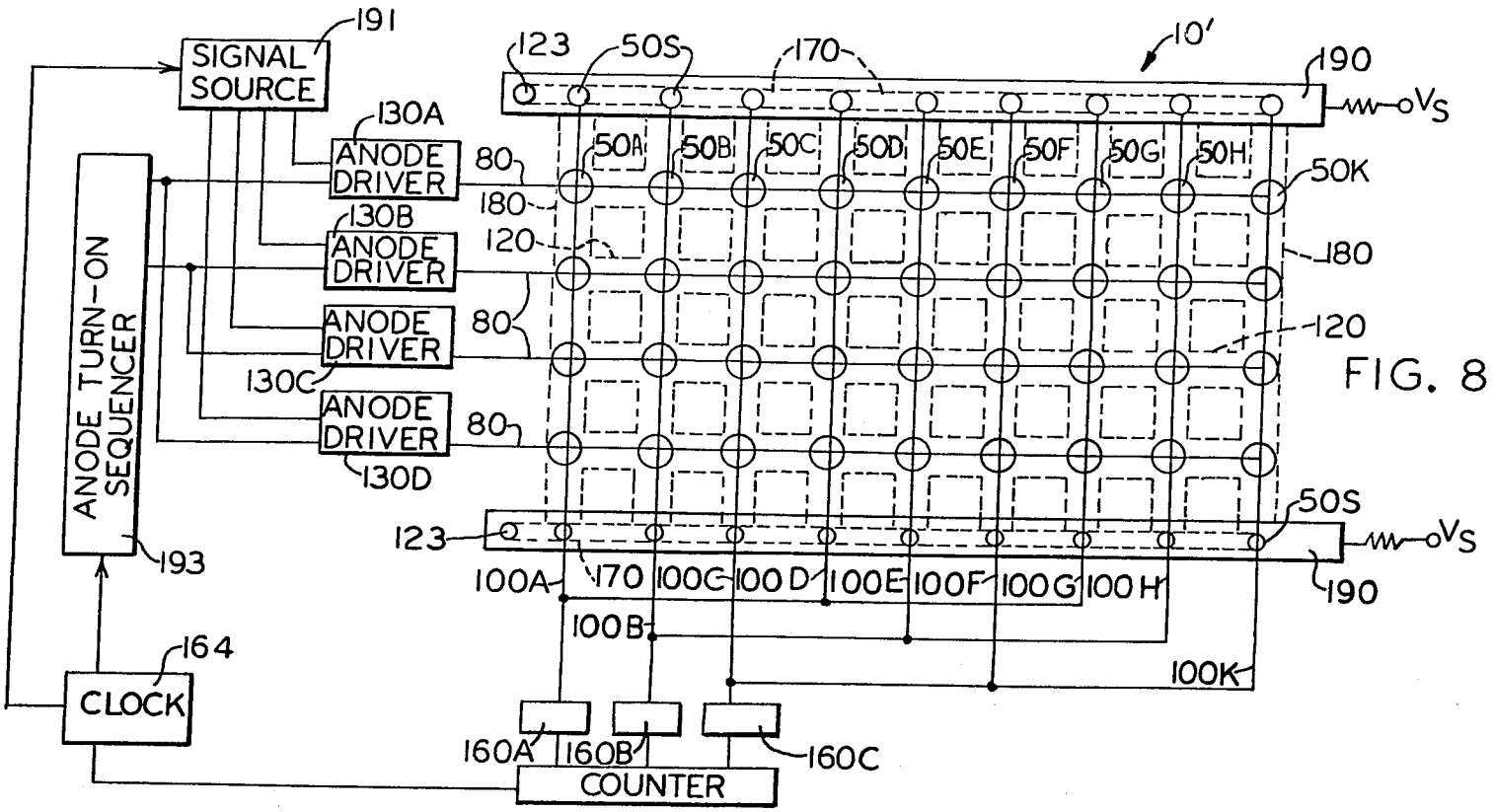
FIG. 8 is a schematic representation of a modification of the display panel shown in FIG. 5 and a system in which it may be operated.

A modified panel 10' and mode of operation are illustrated in FIG. 8, wherein scanning takes place along the columns of cells from left to right as above, but the propagation of excited particles and the turn-on of cells in each column takes place vertically from the top and bottom of a column to the center. The panel 10' includes rows and columns of display cells 50, and, although they are not required in this embodiment of the invention, the horizontal glow coupling slots 120 are provided between adjacent cells as above. The panel 10' includes two rows of auxiliary particle-supply cells 50S, one positioned along the upper margin of the panel and the other positioned along the lower margin, with each cell in these two rows being aligned with a column of display cells 50. The supply cells are coupled together by horizontal particle propagation slots 170 extending along the rows from one cell to the next. In addition, the panel 10' includes vertical particle-propagation slots 180 extending along each column of cells from the lower supply cell 50S through the aligned column of display cells 50 to the upper supply cell 50S.

The panel 10' also includes a keep-alive mechanism or first electron source of the type described above, represented by numeral 123 and positioned in operative relation with the first starter cell in each of the upper and lower rows of supply cells.

In panel 10' shown in FIG. 8, the display cells are provided with anode and cathode electrodes 80 and 100, respectively, as above, and the supply cells 50S share the cathode electrodes 100 but have their own row anodes 190 which can be used to conceal the starter cells from view. Each of these anodes 190 is connected to suitable power supplies Vs so that the supply cells can be energized independently.

In operation of panel 10', the cathode driver 160A for the first column of cells is energized to apply the proper negative potential to first cathode 100A and to the column of cells 50A associated therewith. The first supply cells 50S, at the upper and lower ends of this column, turn ON, with the aid of the first electron source 123, since they now have both anode and cathode potentials applied. This occurs at time *t*1 and is represented by the horizontal line in FIG. 9 for the upper and lower cells 50S. Next, the anode drivers 130, fed by a suitable signal source 191, are energized in order, the outermost drivers 130A and 130D immediately adjacent to the supply cells 50S being energized at time *t*2, and the innermost drivers 130B and 130C at time *t*3. This operation is controlled by a suitable sequencing control circuit 193 driven by clock 164.

Referring to FIG. 9, it will be seen that current flow through the upper and lower 50S cells remains constant throughout the entire scanning cycle. This is as a consequence of the steady anode voltage Vs applied to these cells, and the constant but stepping cathode voltage from drivers 160. Actually, the ON condition remains present in the upper and lower 50S cells, but steps from column to column as the scan progresses.

Shortly after time *t*2, when the glow is transferred to the outermost cells 1 and 4 of column 50A, the current level in these cells is modulated by the anode drivers 130A and 130D to achieve a desired brightness level. At time *t*3, drivers 130A and 130D are turned OFF, extinguishing the glow in cells 1 and 4, and drivers 130B and 130C are turned ON. Cells 2 and 3 thus turn ON, the turn-on being facilitated by the excited particles from cells 1 and 4, and the current level in these cells is shortly thereafter modulated by the anode drivers 130B and 130C.

To scan the column 50B cells, called column B in FIG. 9, cathode driver 160B is energized to transfer the glow from the upper and lower 50S cells in column A to the upper and lower 50S cells in column B. The anode drivers are then sequentially energized, first drivers 130A and 130D and then drivers 130B and 130C, as discussed in connection with the column 50A cells. The column 50C cells are thereafter scanned in a similar way, first transferring the glow to the starter cells of the C column and then sequentially scanning that column. This is repeated for each column of cells in sequence, and the scan repeated at such a rate as to provide a steady but changeable message or picture on the panel.

An alternate way of operating the panel 10' of FIG. 8, which results in a different system, is to eliminate the anode turn-on sequencer 193 and apply the anode currents to the respective anodes 80 simultaneously. In this case, the upper and lower starter cells 50S aligned with column cells 50A are turned ON first by the cathode driver 160A, with the aid of the keep-alive cells 123. Thereafter, the anode drivers 130 apply a positive potential to cells 50A. This has the effect of causing the outermost cells 1 and 4 in column 50A to turn ON at a fixed high current level, these cells having been primed by the adjacent starter cells 50S. The resulting glow in cells 1 and 4 serves to prime the innermost cells 2 and 3, whereupon the latter cells turn ON at a fixed high current level. Thus, all of the cells in column 50A are simultaneously ON for a very brief period, in the order of 5 microseconds.

The anode currents are then modulated, in accordance with the applied signal information, and the cells 50A assume brightness levels dictated by these current levels. The visually OFF level in this case, however, is represented by an extinguished cell, i.e., a cell having zero current flow. This is possible because the upper and lower starter cells 50S in line with cell column 50A are maintained ON, and consequently scanning of the next column 50B is achieved by moving the starter cell glow to the starter cells in line with display cells 50B. Column 50B is then scanned in the manner discussed in connection with column 50A, and the starter glow is then moved to the starter cells 503 in line with column 50C, and so forth until the entire panel is scanned. The scan is then repeated, as discussed.

It will be seen that the panel 10' of FIG. 8 involves both horizontal and vertical scanning. This can also be accomplished by a panel formed of only the display cells 50A to 50H of FIG. 8, since these cells all have vertical and horizontal glow transfer channels between them, a glow discharge established in the upper cell of column 50A, with the aid of a keep-alive or starter cell, can be scanned along the top row from left to right, then transferred to the second row and scanned from right to left, etc., until the entire panel has been scanned, the row anode sequencer 193 being connected to provide the row sequence pattern desired. In synchronism with this scan, modulated anode currents are applied by drivers 130, as discussed, preferably allowing a short delay in modulating until each transfer operation has been completed, to establish the desired display on the panel.

It will be seen, however, that the vertical scanning along the columns of display cells 50A to 50H in panel 10', unlike the horizontal scanning, utilizes glow coupling channels between anodes and thus involves anode switching. To avoid the problems already discussed in connection with anode switching at high pressures, one can simply reverse the anode and cathode voltages, so that the anodes serve as cathodes and the cathodes serve as anodes. This can be done at each point in the scanning cycle where a change from horizontal to vertical scanning is desired, and the voltages returned to their normal sense when horizontal scanning is again desired. Indeed, in the display panels of the present invention, the anodes and cathodes are generally interchangeable in function, and consequently, a switching network can be incorporated to reverse the cathode-anode voltages whenever there is a change from horizontal to vertical switching or vice-versa — so that both vertical and horizontal scanning utilize cathode switching.

The structure and theory of operation of display panels of the type disclosed wherein are described in a number of issued patents such as U.S. Pat. No. 3,766,420, 3,875,474, and 3,989,981, which are incorporated herein by reference.

What is claimed is:

1. A gas discharge display device including
a gas-filled envelope,
at least one series of display positions disposed along a line in said envelope,
auxiliary particle-supply cells at opposite ends of said line,
means for initiating a glow discharge substantially simultaneously in selected ones of said auxiliary cells, to facilitate the generation of glow discharges in the adjacent display cells along said line and in the adjacent auxiliary cells, and
means for scanning the display cells starting with the two display cells which are next adjacent the selected auxiliary cells and moving toward the center of the line.

2. The device defined in claim 1 and including a plurality of parallel lines of display positions, each such line having an auxiliary cell at the opposite ends thereof.

3. A gas discharge display device including
a gas-filled envelope,
a plurality of display cells arrayed in rows and columns, there being a series of columns of such display cells,
auxiliary particle-supply cells at opposite ends of each said column of display cells, there being auxiliary cells for each column of display cells and there being two series of auxiliary cells,
means for initiating a glow discharge substantially simultaneously in the auxiliary cells associated with each column of display cells to facilitate the generation of glow discharges in the adjacent display cells along the column, said means also initiating glow discharge sequentially in the two series of auxiliary cells, and
means for scanning the display cells in each said column starting with the two display cells which are next adjacent the auxiliary cells and moving toward the center of the column.

4. A gas discharge display device and system for operating the same including
an envelope having a viewing window,
a gaseous atmosphere in said envelope,
at least one series of display positions along a line within said envelope, each such display position including at least one gas discharge display cell and a plurality of electrodes associated therewith,
auxiliary gas discharge particle-supply cells adjacent the display cells at the opposite ends of said line,
a plurality of electrodes associated with each of said auxiliary cells in gas discharge relationship therewith,
conductive means connected to the electrodes of the auxiliary cells for initiating a glow discharge in said auxiliary cells, to facilitate glow discharges in the display cells at the opposite ends of said line,
means for scanning said gas discharge cells, starting with said initiation of glow discharge in the auxiliary cells, then the next adjacent display cells at the opposite ends of the line, then the next adjacent cells moving toward the center of the line, and continuing to the two centermost display cells in said line, and
means for repeating said scan periodically.

5. The apparatus defined in claim 4 wherein said envelope includes a base plate and face plate hermetically sealed together, said face plate including said viewing window.

6. The apparatus defined in claim 4 wherein an open area is provided between the successive display positions so that excited particles generated by the glow discharge at each such position facilitates the initiation of glow discharge in the next adjacent position.

7. The apparatus defined in claim 4 and including means for selectively activating the electrodes associated with said display cells.

8. A gas discharge display device including
a gas-filled envelope,
at least one series of display cells disposed along a line in said envelope,
auxiliary glow discharge particle-supply cells at opposite ends of said line,
means for initiating a glow discharge substantially simultaneously in selected ones of said auxiliary cells, to facilitate the generation of glow discharges in the adjacent display cells along said line and in the adjacent auxiliary cells, said glow discharges lying along a common plane with the glow discharges of said auxliary cells, and
means for scanning the display cells starting with the two display cells which are next adjacent the selected auxiliary cells and moving toward the center of the line.

9. The device defined in claim 8 and including a plurality of parallel lines of display cells, each such line having an auxiliary cell at the opposite ends thereof.

10. A gas discharge display device including
a gas-filled envelope,
a plurality of display cells arrayed in rows and columns, there being a series of columns of such display cells,
auxiliary glow discharge particle-supply cells at opposite ends of each said column of display cells, there being auxiliary cells for each column of display cells and there being two series of auxiliary cells,
means for initiating a glow discharge substantially simultaneously in the auxiliary cells associated with each column of display cells to facilitate the generation of glow discharges in the adjacent display cells along the column, said means also initiating glow discharge sequentially in the two series of auxiliary cells, the glow discharges in said auxiliary cells and in the display cells all lying in a common plane, and
means for scanning the display cells in each said column starting with the two display cells which are next adjacent the auxiliary cells and moving toward the center of the column.

11. A gas discharge display device including
a gas-filled envelope having a viewing window, at least one series of display cells disposed along a line in said envelope, an auxiliary glow discharge particle-supply cell disposed adjacent to one of said display cells, a common cathode electrode lying along said series of display cells and forming the cathode for each display cell and auxiliary glow discharge cell along said line, means for initiating a glow discharge in said auxiliary cell to generate excited particles and to facilitate the generation of glow discharges in the adjacent display cells along said line, the glow discharges in said auxiliary cell and in said display cells all being adjacent to the same surface of said common cathode electrode, and means for scanning the display cells starting with the display cell which is next adjacent to the auxiliary cell and moving along said series of display cells.

12. The device defined in claim 11 and including a plurality of parallel lines of display cells, each such line having an auxiliary cell associated therewith.

13. The device defined in claim 11 and including a plurality of auxiliary glow discharge cells associated with said series of display cells and with said common cathode electrode.

14. The device defined in claim 12 and including a plurality of auxiliary cells associated with each line of display cells.

15. The device defined in claim 11 wherein said cathode is a metal strip having a top surface facing said viewing window, said auxiliary cell and each display cell including a portion of the top surface of said cathode electrode.

16. A gas discharge display device including a gas-filled envelope, a plurality of display cells arrayed in rows and columns, there being a series of columns of such display cells, auxiliary glow discharge particle-supply cells adjacent to opposite ends of each said column of display cells, there being auxiliary cells for each column of display cells and there being two rows of auxiliary cells, a common cathode strip electrode lying along each column of display cells and forming the cathode for each display cell and auxiliary glow discharge cell in a column, an anode electrode associated with each display cell and auxiliary glow discharge cell, means for initiating a glow discharge substantially simultaneously in the auxiliary cells associated with each column of display cells to facilitate the generation of glow discharges in the adjacent display cells along the column, said means also initiating glow discharge sequentially in the two series of auxiliary cells, the glow discharges in said auxiliary cells and in the display cells all lying in a common plane, and means for scanning the display cells in each said column starting with the two display cells which are next adjacent the auxiliary cells and moving toward the center of the column.

* * * * *